United States Patent [19]

Tunis, III

[11] Patent Number: 4,907,518

[45] Date of Patent: Mar. 13, 1990

[54] PLANING HULL FOR MULTI-HULL SAIL BOATS

[76] Inventor: George C. Tunis, III, 2908 Creekside Dr., Newark, Del. 19711

[21] Appl. No.: 336,917

[22] Filed: Apr. 12, 1989

[51] Int. Cl.[4] ..... B63B 1/10

[52] U.S. Cl. ..... 114/56; 114/61

[58] Field of Search ..... 114/39.1, 61, 123, 56, 114/57, 274, 283, 292

[56] References Cited

U.S. PATENT DOCUMENTS

| | | | |
|---|---|---|---|
| 4,498,409 | 2/1985 | Edel | 114/61 |
| 4,708,077 | 11/1987 | Balquet et al. | 114/61 |
| 4,811,676 | 3/1989 | Franke | 114/61 |
| 4,813,366 | 3/1989 | Elder | 114/61 |
| 4,817,548 | 4/1989 | Guergen | 114/61 |
| 4,836,120 | 6/1989 | Murphy | 114/61 |

*Primary Examiner*—Sherman D. Basinger

*Assistant Examiner*—Stephen P. Avila

*Attorney, Agent, or Firm*—Shlesinger & Myers

[57] ABSTRACT

A multi-hull sailing craft has a pair of essentially aligned parallel interconnecting air foil shaped hulls. Each hull has a vertical flat outwardly curved inner side surface for generating lift and terminating at a lower edge which defines the keel line. The outer side terminates at its lower edge along a chine line. A flat bottom planing surface extends between the chine and the keel, and is downwardly inclined at a substantial dead rise angle to produce both a substantial dynamic buoyant force for moving the hull upwardly and onto the bow wave, and for supplying a lateral force to supplement the lifting force generating along the inner surface. The resulting intersection of the three surfaces producing a keel line which has a convex curvature in both the horizontal and vertical plane.

10 Claims, 4 Drawing Sheets

FIGURE 11
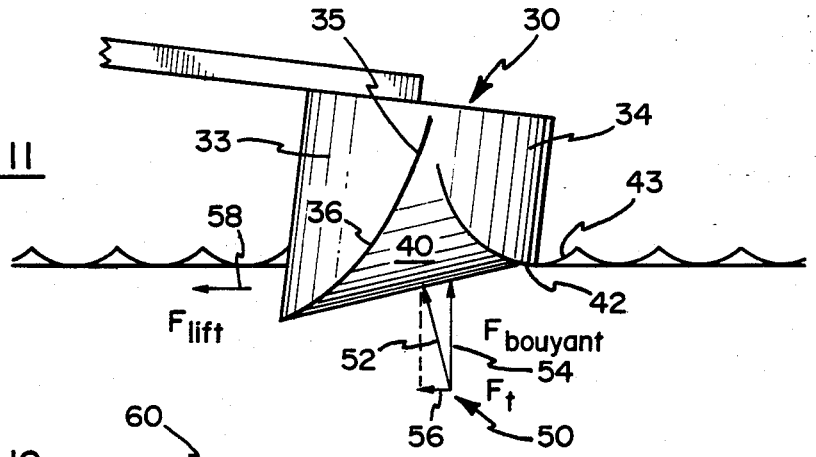
FIGURE 12
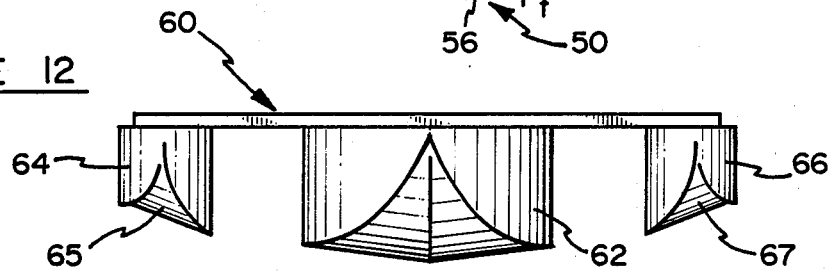
FIGURE 13 HULL VELOCITY VS WIND VELOCITY FOR 18 FT DISPLACEMENT & PLANING CATAMARANS
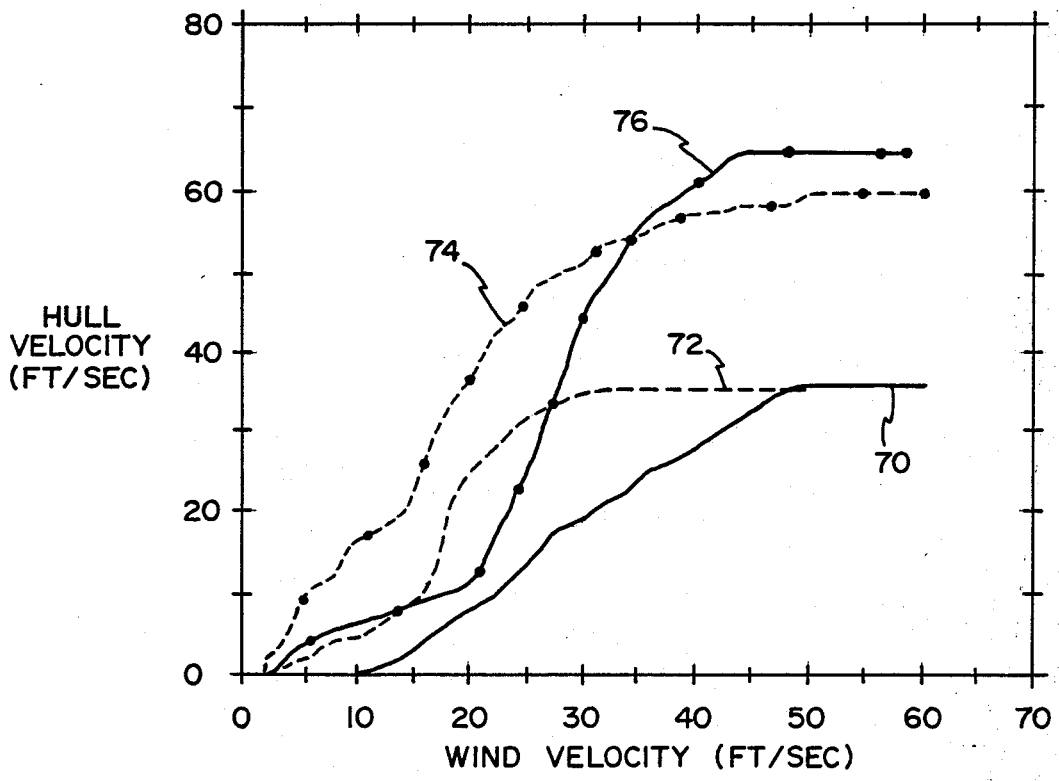

FIGURE 14 DRAG VS VELOCITY
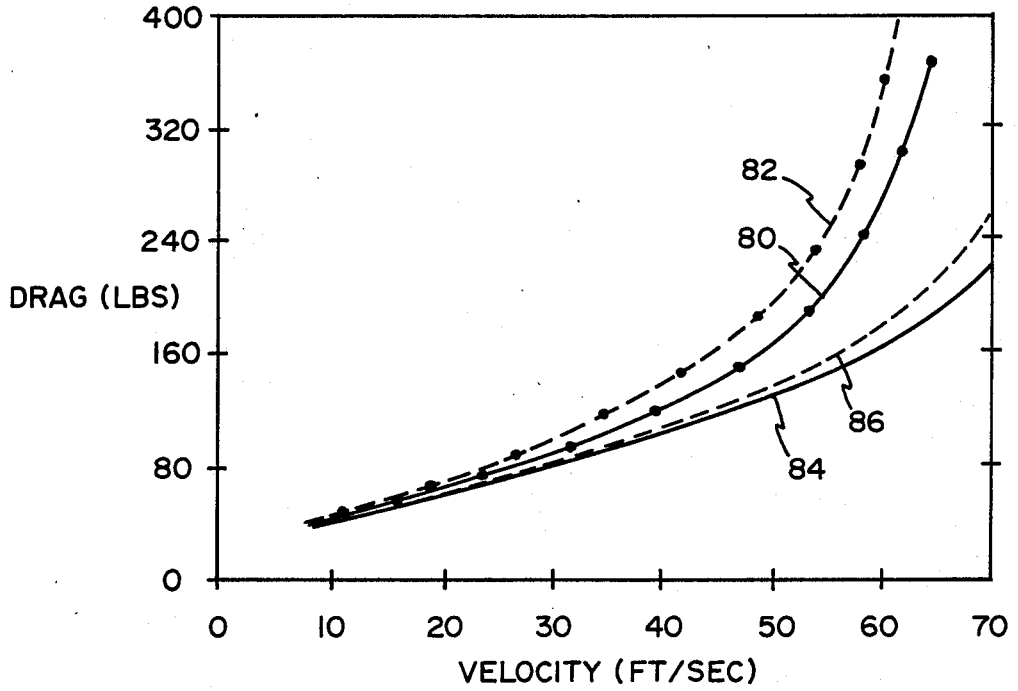
FIGURE 15
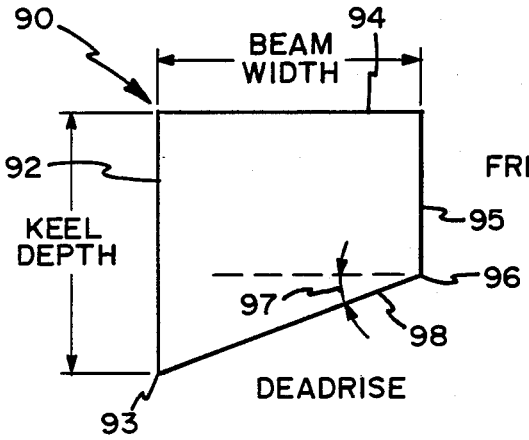
KEEL DEPTH = TANGENT (DEADRISE ANGLE) (BEAM WIDTH) + FREEBOARD
FIGURE 16
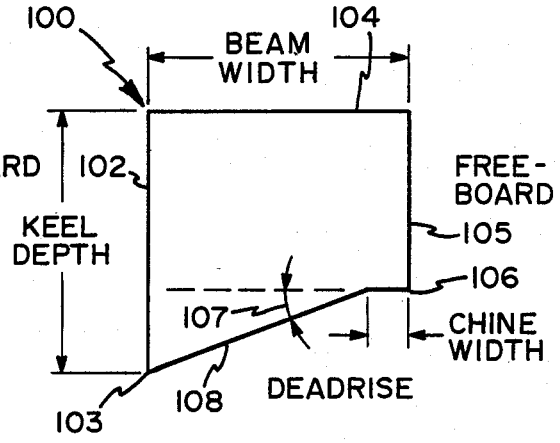
KEEL DEPTH = TANGENT (DEADRISE ANGLE) (BEAM WIDTH) - CHINE WIDTH + FREEBOARD

PLANING HULL FOR MULTI-HULL SAIL BOATS

FIELD OF THE INVENTION

This invention relates to a boat hull design, and particularly to a new type of hull for multi-hull sail boats, specifically catamarans, and trimarans.

The catamaran sail boat brought about such a radical change in sail boat performance and speed over traditional mono-hull displacement sail boats. Due to its light weight construction and dual hull design, that it could be said to have revolutionized sail boat performance.

The multi-hull catamaran design had limits, however, since at higher speeds the catamaran, as with typical displacement hulls, encountered increased drag resistance on the hull. Also, the sail forces tended to nose it down as the bow and possibly cause a dangerous pitch pole (overturn end over end).

This invention is directed to the increasing of speed capability of a multi-hull sail boat, and to eliminating the possibility of a pitch pole accident at the higher speeds.

It has long been known that there is an upper limit to displacement hull speeds because of generation of a very high drag force due to the bow wave generated by the hull as it moves through the water. The drag on the hull by the bow wave increases progressively with speed until it reaches a maximum which presents such a barrier that the hull speed cannot exceed that value. The greater the length of the hull, the higher the attainable speed before that bow wave condition is reached.

This invention seeks to overcome this drawback by designing a different type of hull which overcomes the bow wave problem, and yet provides sufficient lateral resistance to side forces produced by the sails to give good boat handling characteristics for upwind performance.

SUMMARY OF THE INVENTION

Accordingly, this invention contemplates the use of a new type of hull for a multi-hull sail boat which will provide higher speed, decreased pitch pole tendencies, and good boat handling characteristics.

This is provided by a planing type hull which is preferably symmetrical about a longitudinal center line to provide a relatively large side lifting force due to flow at an angle of leeway over an air foil shaped surface. A specially configured bottom surface is also provided to provide a planing surface to climb over the bow wave and to provide both a buoyant force to lift the hull upwardly out of the water and over the bow wave and also provide an additional lateral side force to resist side slippage of the hull, common during upward sailing legs.

The lifting force and a lateral force in this hull, both provide the total reactive force to the sail generated side force.

Extensive analysis of forces effecting both hull and sails, was conducted to determine the viaibility of such a configuration, and to find the optimum hull design for this type of hull. The resulting hull shape found to be optimal, has an air foil configuration with inner and outer sides configured in a low drag, high lift curved hydrodynamic shape, and a bottom planing surface with a low and constant dead rise angle and with a minimum of twist from the bow to stern.

This new planing hull form has the advantage of the combined attributes of both the displacement hull by providing side force lift, and a planing bottom particularly configured to provide both a large planing or dynamic buoyant force for climbing up over the bow wave and provide additional lateral force to act with the lifting force to counteract the side force generated by the sails.

The bottom surface extends across the entire width of the hull, rising at a dead rise angle from the keel line disposed on the inside of the hull to a hard chine extending along the outside of the hull.

The hull keel extends along and immediately below the inner side surface to maximize air foil surface area and the lifting force generated by it along its surface, acting at its center of pressure.

The keel line also rises at a small angle at both the bow and stern sections of the hull. The keel curvature in both the horizontal and vertical planes, produces what can be described as a three dimension curved keel which extends along the inside surface of the hull. It results in maximum lifting force generation in the heeled condition from the hull side surface, and maximum lateral force component from the inclined planar bottom surface. With the minimum of surface area possible, it is a much higher riding hull at high speeds which encounters much less drag and eliminates tendency to pitch pole.

This design configuration departs dramatically from the conventional displacement hull design of catamaran hull designs. The combined configuration gives good performance at both low and high speeds gives substantially greater maximum speed, and substantially greater resistance to sail generated side forces.

DESCRIPTION OF THE DRAWINGS

FIG. 11 is an enlarged view of FIG. 10, illustrating the forces acting thereon.

FIG. 12 is a front view of a trimaran having planing hulls.

FIG. 13 shows a set of hull velocity versus wind velocity curves.

FIG. 14 shows a set of drag versus velocity curves.

FIG. 15 is a cross-section of a hull with no chine width

FIG. 16 is a cross-sectional view of a hull with a chine width.

DETAILED DESCRIPTION OF THE INVENTION

Figure 1:
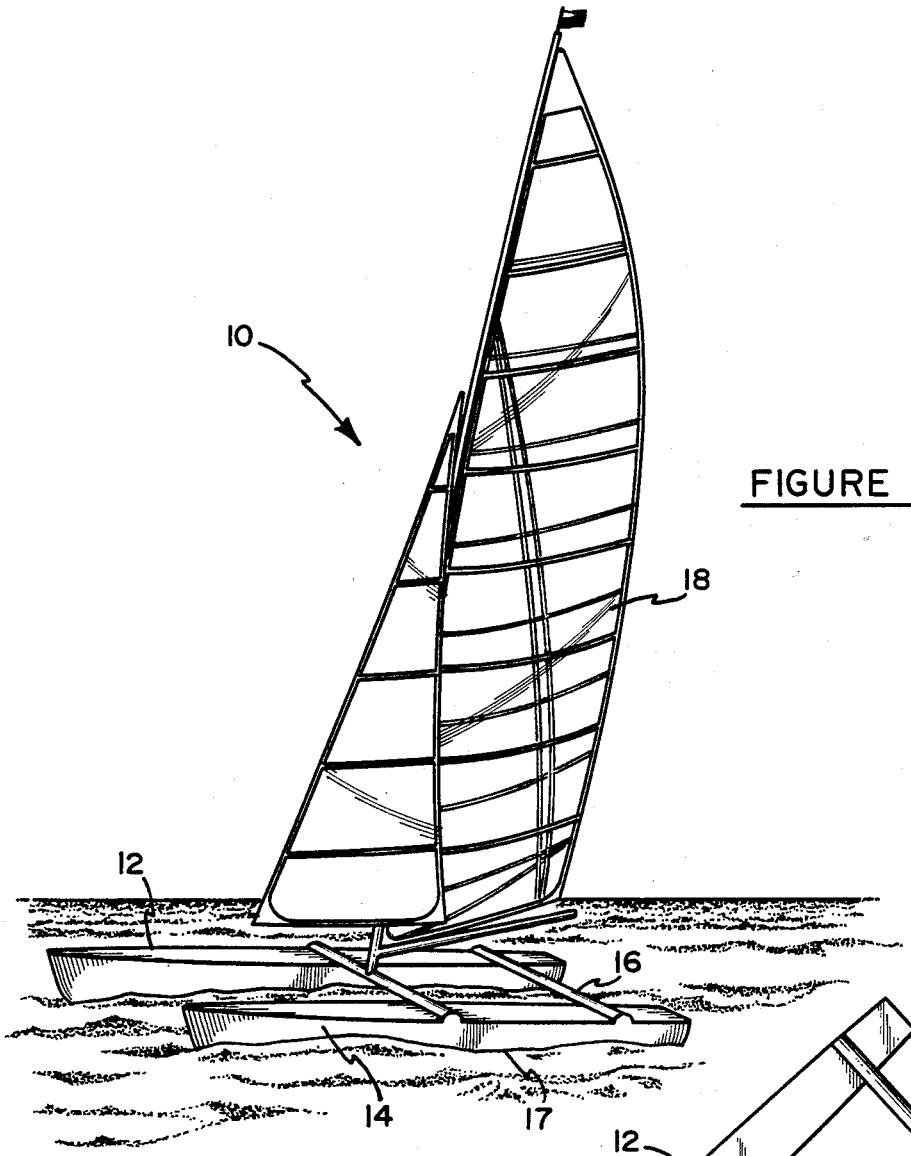
FIG. 1 is a perspective view of a typical catamaran underway, traveling at an angle of heel.

Referring particularly to the drawings, FIG. 1 shows a catamaran generally indicated at 10 having hulls 12 and 14 under way at high speed. Hull 12 is raised up slightly clear of the water, while hull 14 rides relatively low in the water supportinq the entire boat. The hulls 12 and 14 are interconnected by rigid support frame elements 16, and driven by the sail 18. Note that hull 14 has a substantial bow wave 17 followed by a trough. This is typical for ordinary catamaran displacement hulls, which primarily support the weight of the boat and crew, from buoyancy forces equal to the equivalent right of the displaced water.

Figure 2:
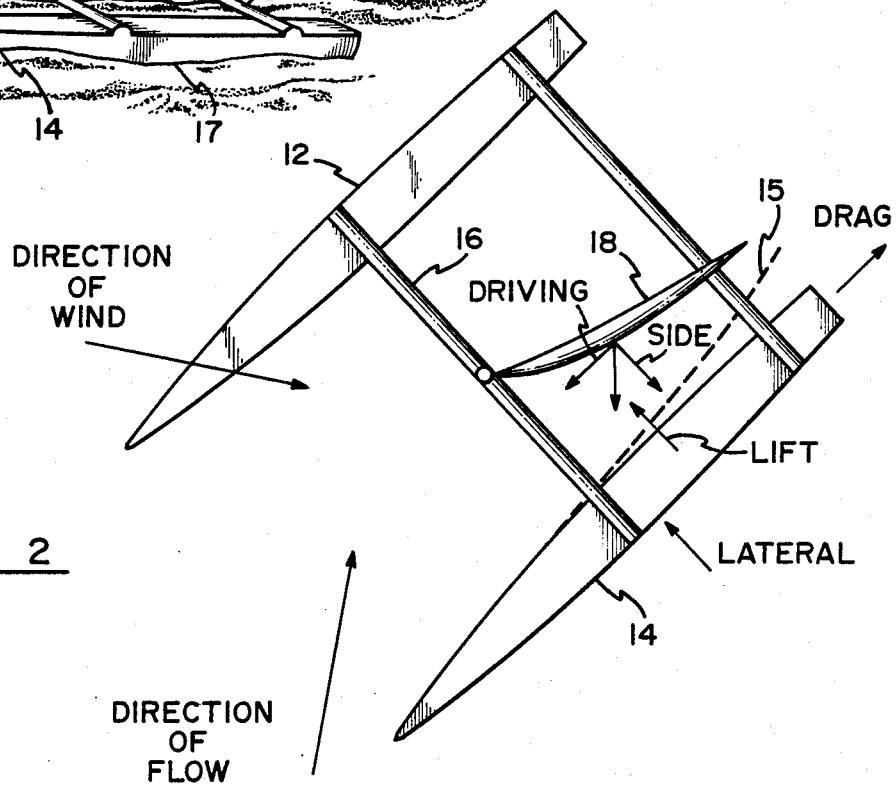
FIG. 2 is a plan view of the catamaran of FIG. 1, traveling at an angle of leeway.

FIG. 2 is a top view of the catamaran of FIG. 1, showing the direction of wind and direction of water flow with respect to the hulls 12 and 14 and the sail 18. The hulls planar configuration are relatively long and slender. Hull 14, being the only hull in the water, encounters a drag force tending to reduce speed. The drag force is created predominately by wave drag at the terminal speed; however, up to near the terminal velocity, the majority of resistance is caused by a combination of form drag and surface friction. A transition to turbulent flow and subsequent separation of flow from the inside hull surface, generally indicated at 15, produces the form drag and generally increases the surface friction. A hydrodynamicly smooth inside surface will minimize this behavior. Equally important, the hydrodynamicly smooth surface traveling at an angle to the flow, will cause the acceleration of flow, as compared to the outside surface, producing a lifting force normal to the surfaces. A summation of this force can be said to act as the center of pressure which is always near the area of maximum thickness. This force is governed by the Bernoulli equation and similar to that generated by an airplane wing.

The sail 18 transmits the wind force which has a driving force component and a side force component. The lift force, discussed above, generated by the acceleration of flow over the inside surface counteracts the side force from the sail. For the case of a displacement catamaran, only this force counteracts the sail side force. For the case of a hybrid planing hull, a second side force countering additive force is present, which results from a component of the forces produced on the hard chine planing bottom surface. This force has been shown in FIG. 2 as lateral and is shown to act at the center of pressure of the bottom surface. (Note the center of pressure of the inside surface does not necessarily correspond to the center of pressure of the bottom surface) The force lateral force will only be present in the case of the hybrid planing hull and will be discussed in more detail later. (Note the buoyant force is the vertical component of the normal planing force. The displacement force is additive and is generated by the static displacement of water.

Figure 3:
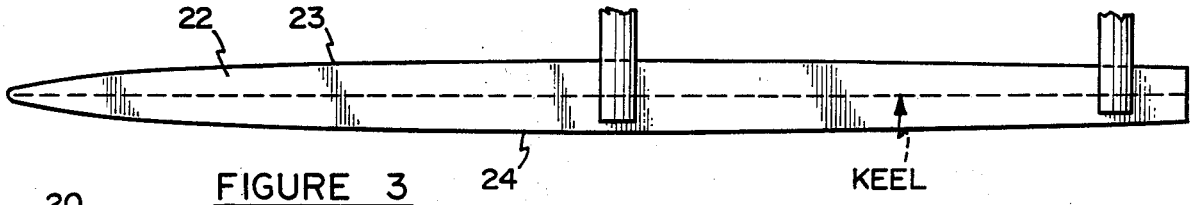
FIG. 3 is a top view of a hull of the catamaran of FIG. 1.
Figure 4:
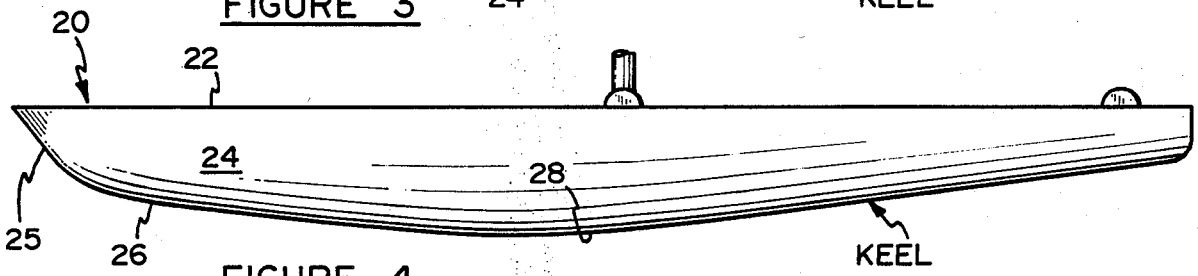
FIG. 4 is a side view of the hull of FIG. 3.
Figure 5:
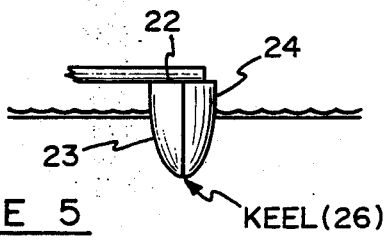
FIG. 5 is a front view of the hull of FIG. 3.

The typical catamaran hull, which is a displacement type hull, is shown in FIGS. 3, 4, and 5. The hull generally indicated at 20, has symmetrical or slightly a symmetric air foil shape. Flat deck 22 has symmetrical curved sides 23 and 24 extending downwardly to the keel. The bow 25 meets the keel 26 which extends downwardly to the lowermost section 28, and then upwardly to the stern to provide a rocker configuration, as shown in FIG. 4. Note that the bottom surfaces generally follow the rocker configuration of the keel line.

The front view of the hull shown in FIG. 5, illustrates the depth at which this type of displacement hull will lie in the water. Most of the volume of the hull is submerged with some freeboard distance between water level and hull deck 22.

Figure 6:
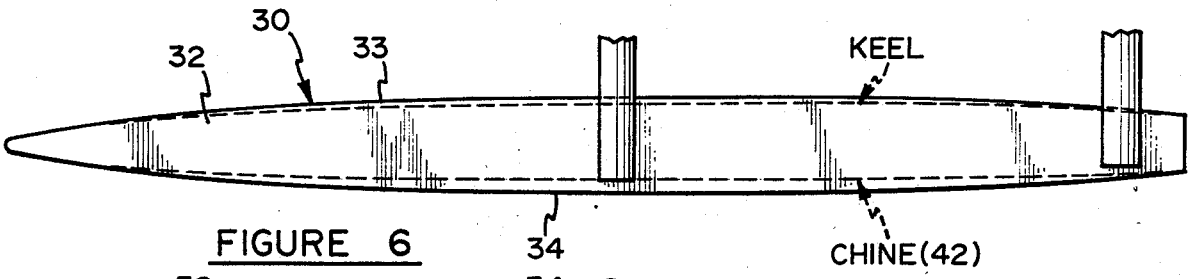
FIG. 6 is a plan view of the new hull design.
Figure 7:
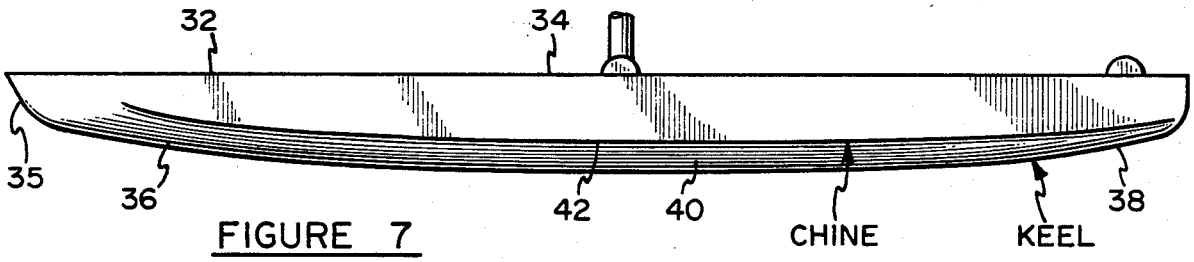
FIG. 7 is a side view of the hull of FIG. 6.
Figure 8:
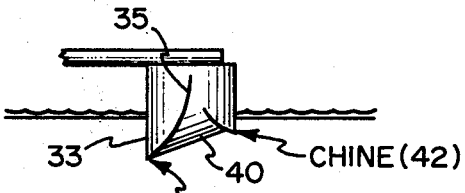
FIG. 8 is a front view of the hull of FIG. 6.

FIGS. 6, 7, and 8 which respectively correspond to FIGS. 3, 4 and 5, show the new planing hull configuration. FIG. 6 shows the plan view of hull 30 at the deck 32. It has a pronounced air foil configuration, and has a wider beam than the corresponding typical catamaran hull shown in FIG. 6 to incorporate the necessary bottom area for planing performance. The sides 33 and 34 are vertical, as shown in FIG. 8. This contrasts with the thinner hull configuration and inwardly arcing hull sides 23 and 24 of the conventional hull as shown in FIG. 5. Bow 35 joins the downwardly sloping keel 36, which is the lowermost portion of vertical side 33. It slopes downward toward the central portion of the hull in a very slight inclination reaching a maximum distance from the deck at a point determined by the location of a combination of the maximum beam width and bottom surface rocker configuration. (Note bottom surface rocker and chine line inclination can be directly related. Keel line inclination can only be related to bottom surface rocker through the trigometric relationships described by FIG. 15 and FIG. 16). The keel line forms a continuous flowing curve sloping slightly upward aft of this location, as shown in FIG. 7 at stern section 38.

The flat or slightly concave upwardly inclined bottom 40 extends from the keel 36 to a hard chine 42 as shown in the front view of FIG. 8. The front view of the hull shows the hull in relation to the water line at rest or at slow speeds. The water line is slightly above the chine 42. Slightly more freeboard from water line to deck 32 is shown in this configuration. Because of the greater width, the planing hull sits slightly higher in the water and the displacement hull, although for identical weight the same volume of water, would be displaced.

Figure 9:
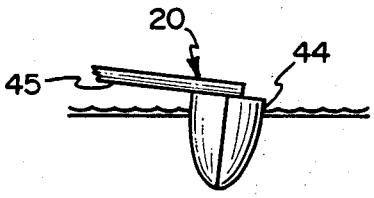
FIG. 9 is a front view of the hull of FIG. 3 at high speed.
Figure 10:
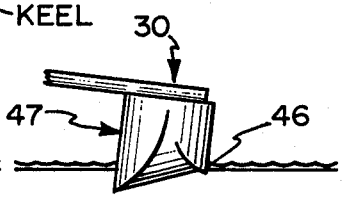
FIG. 10 is a front view of the planing hull at high speed.

FIGS. 9 and 10 show by a comparison how the conventional hull 20 has a tendency to bury itself low in the water with the side 44 close to the water line at high speeds. Note that there is only a small clearance 45 between these supports and the water line.

FIG. 10 shows the front view of the planing hull of this invention shows that at high speeds, the hull rises up so that the water line at 46 is at the chine 42. The inside surface of the hull is partly submerged in the water and provides lift due to the air foil surface. The freeboard length 47 is substantially greater than the freeboard for a displacement hull. Although there is generally more wetted surface at rest for the hybrid hull, there is actually less wetted surface, and less fluid drag experienced by this hull at the high speed condition.

The enlarged view of the new hull showing the forces that are developed to bring about this condition, are shown in FIG. Il. The chine is at the water line, and the inclined planing bottom 40 in riding over the water at the high speeds rises up over the bow wave normally encountered with displacement hulls, because of the forces shown diagrammatically at 50. The perpendicular resultant force 52 has a vertical dynamic buoyant force 54 which raises the hull upwardly. This force is a combination of the static buoyancy force and the vertical component of the dynamic planing force. The horizontal lateral force 56 is the horizontal component of the force 52 exerted by the water at the center of pressure of the bottom surface. Because of the large force exerted on this inclined surface, although the angular inclination of the surface is small, and the force component 56 appears to be small as compared to the vertical force, the actual lateral force exerted is large.

The inside surface 33 of hull 30 provides a strong lifting force 58. Both forces 56 and 58 are directed toward the boat center line and are sufficiently large to offset the counteract lateral side force exerted on the hull by the sails. Because outward of their additive nature, the hull has a higher lift to drag ratio, i.e., all surfaces work together to produce additive beneficial forces.

FIG. 12 shows a trimaran configuration 60. The central displacement hull 62 has two outrigger symmetrical curved keel planing hulls of this invention. The hull 64 has an outwardly facing inclined planing bottom 65, and a hull 66 having an outwardly facing planing bottom 67 similar to the configuration of a dual hull catamaran.

The big difference in performance characteristics between a typical displacement hull type catamaran having a typical hull configuration as shown in FIGS. 3, 4 and 5, and the three dimensional curved keel hybrid planing hull of this invention are shown in FIG. 13. The hull velocity versus wind velocity curve 74, has a sailing direction angle with respect to the wind of 90 degrees. A similar curve for a displacement hull is shown at 72. Note that at a wind velocity of 50 feet per second, a planing hull achieves a maximum velocity of approximately 60 feet per second, while the displacement hull has a maximum speed of 30 feet per second.

A similar marked difference in performance is shown by the curve 70 for a displacement hull sailing at 135 degrees angle, with respect to the wind. The corresponding curve 76 for the planing hull of this invention, shows a difference of over 30 feet per second.

These results were obtained from computer computations using a mathematical model of the complete sailing system. The hull or hulls were modelled based on accepted hydrodynamic thery (Savitsky, Daniel, "Hydrodynamic Designs of Planing Hulls" Marine Technology Vol. 1, No. 1, October 1964). The sail forces for the catamaran were mathematically modelled and based on accepted aerodynamic thery (Marchaj, C. A. AeroHydrodynamics of Sailing). Both models were computerized using Fortran to allow for the rapid computation of data from the complex relationships needed to solve the equilibrium equations. When the two models were combined, optimization for a planing design could quickly be completed given certain design restrictions such as sail area, desired length, total weight (crew and boat), and weight distribution. Additionally, using the combined models, comparisons could be made to commercially available displacement designs to both validate the model's accuracy and quantify the performance improvements brought about by the planing design.

Results were based upon assumptions for different conditions and their interaction for such variables as total load and location, average beam width, bottom dead rise angle, total craft width, thrust location and inclination, velocity range, trim angle, drag force, horse power requirements, draft of keel, wetted keel and chine lengths, sail area and geometric center, hull velocity, and wind direction and strength.

In summary, the essence of the invention is the three dimensional curved keel concept which includes the horizontal and vertical plane curved keel design, having geometric optimum for creating a hybrid hull which contains the necessary parameters for both planing performance and side force countering performance when sailing in the heeled condition. Any other possible geometric solution has the penalty of either increased surface area, high form drag or excessive bottom concavity.

The optimum design will have a constant dead rise section extending from the stern to the wetted keel and chine lengths, as predicted by the computer program for a given sailing configuration. Ahead of this region, extending to the bow, a progressive twist will be incorporated to minimize the effect of wave decelerations to avoid any discontinuities in the keel line as viewed by the side and to make a smooth transition from the bow to the constant dead rise section, a progressive twist function must be used. In most cases, this function is a second or third order polynomial.

On the basis of these calculations, a typical and preferred design for an 18 foot dual hull catamaran, assuming a total weight of 600 pounds (including crew), a center of gravity location 4½ feet from the stern, and sail area of 233 square feet, showed an average beam width of 1.5 feet and an average dead size angle of 20 degrees to be preferable.

Further calculations showed that for the design parameters discussed above, there were actually a range of solutions possible using the curved keel as a starting point. By exploring this solution range, variations of the 8 foot design could be assembled for almost any sailing condition from flat water to open ocean sailing. Depending on intended use, the bow dead rise angle should range from 2 to 90 degrees (90 degrees being intended for rough water) to help minimize wave decelerations. Similarly, the mid and rear section of the hull should have a constant dead rise ranging from 2 to 50 degrees (50 degrees being intended for up wind performance) to maximize the planing performance. By using the calculation outputs for wetted chine length and wetted keel length, it was also shown that the optimum planing area should be located within the region defined by 13 feet of the chine line and 17 feet of the keel line, as measured from the stern. Likewise, the steeper section intended to limit wave decelerations, should be located ahead of this region.

The design example discussed has been for an 18 foot design, where a well balanced design was found using a steep bow entry followed by a progressively changing twist to a constant 20 degree dead rise surface in the mid and rear sections. Similar calculations could be made for any size sailing vessel using the curved keel concept to explore as solution range and specific optimum. The real importance of the curved keel base line design is that the planing surface remains effective in the heeled condition, the side forces are all additive in the correct direction to reduce side slip and the drag caused by traveling at the angle of leeway is minimized.

The drag versus velocity of FIG. 14 illustrates the effect of varying beam width and dead rise angle. The dead rise angle is the angle that the bottom planing surface makes with a line parallel to the deck of the hull horizontal, as shown in FIGS. 15 and 16.

The drag versus velocity curves for the planing hull show that the highest drag is encountered with the upper pair of curves in the high speed range where the hull bottom has an average dead rise angle of 30 degrees, as shown by curves 80 and 2. Curve 82 has the lower drag, although the hull average beam width of 1½ feet is wider. Curve 82 represents a hull having an average beam width of 1 foot. Note that these 30 degree dead rise angle curves show that drag raises sharply in the higher speed area.

In contrast, the drag versus velocity curves for the planing hull configuration with an average dead rise angle of 20 degrees as represented by the curves 84 and 86, show about the same drag as the upper set of curves in the lower hull speed ranges, but are substantially less in the higher speeds above 50 feet per second (35 mph). Curves 84 and 86 also show that the drag for a 1.5 foot average beam width hull is less than a 1 foot beam width hull. The importance of dead rise angle is illustrated by the drag values at 60 feet per second (40 mph). For the 20 degree dead rise angle curves, the drag is slightly less than 160 pounds, while the drag for the 30 degree dead rise angle curves is almost 300 pounds.

The cross-sectional configuration of the curved keel planing hull 90 is shown in FIG. 15. The keel depth at any point along the inner curved surface 92 of the hull extends from the keel 93 up to the level of the deck 94. The outer side 95 extends downwardly from the deck 94 to the chine line 96. The planing surface 98 extends from the keel 93 to the chine 96. The angle of dead rise 97 is the angle between the planing surface 98 and a line parallel to the deck 94.

In order to construct the hull, it has been found that it is essential to understand the relationship, that the keel depth equals the tangent of the dead rise angle 97 multiplied by the beam width (which is the width of deck 94) plus the free board which is the vertical depth of the outer side 95, (i.e., distance from deck 94 down to the chine 96). This relationship is used for determining where the keel should be for any point along the planing surface of the hull. Keeping the dead rise constant, which is an important design consideration in constructing this hull, is difficult because of the curvature of the inner and outer hull surfaces and the rocker curve of chine and keel. If this formula is not used, first starting with the chine line rocker and second calculating the keel line location using the formula, three common mistakes can easily be made which adversely affect the design's performance. These common mistakes are (1) excessive bottom twist in the planing region, (2) excessive bottom surface concavity, and (3) or chine line concavity. All three mistakes severely affect the flow of water along the hull limiting the performance.

To give greater buoyancy or to enhance spray redirection, the hull can also be widened by introducing a chine width. The calculation for keel depth is similar to that of the hull configuration of FIG. 14, except that the chine width must be considered and subtracted from the beam width value.

For the hull cross-section of the hull 100, having a chine width, the inner side surface 102 terminates at the keel 103. The free board is designed to extend from the deck 104 downwardly along the outer curved hull surface 105 to the chine 106 which is at the water line. The chine width is a difference in horizontal length between the chine 106 and the upper end of the inclined flat planing surface 108. The dead rise angle 107 is measured at the intersection of the chine width line and the inclined planar bottom surface.

The formula for computing the keel depth for this configuration is shown. Specifically, the keel depth equals the tangent of the dead rise angle multiplied by the beam width minus the chine width, to which the free board length for the hull along surface 105 is added. It should be noted that "hard chine" has been used to describe the configuration on the outside edge at the waterline. Although a true "pointed" hard chine is optimum for flow separation at high speed, any "softer" configuration (a configuration with a small radius at the chine line) that serves the purpose of flow separation at high speeds, is acceptable and intended to be covered by this patent.

SUMMATION

This new hull design which can be characterised as a hybrid planing/displacement type hull provides the advantages of the planing and displacement type hulls in a modified hull design which minimizes the disadvantages of each hull type.

The air foil design of displacement type hulls is selected to generate high lift or lateral force. The usual downwardly curving sides of the conventional displacement multi-hull are replaced with flat vertical surfaces which are curved in the horizontal plane to give a relatively thick air foil section (approximately 10% thickness) having a high length to width ratio, as compared to traditional power boat planing hulls. These sides are curved in a long air foil shape and extend vertically downward. The inner lifting force generating surface area is maximized by moving the keel line over to coincide with the lower edge of this surface to give the maximum surface area to create lift. Also, by moving the keel line to the inside edge, the bottom surface is also maximized as the entire surface is correctly aligned for creating dynamic lift in the heeled condition.

This differs greatly from standard practice developed by the power boat industry where the keel line is always straight.

The outer surface complements the shape of the inner surface but merely extends down to the level of the water line point at high speeds terminating at a hard chine. The height of this surface is the freeboard length which is somewhat higher than conventional catamarans to give additional clearance from wave chop. The flat vertical side terminating on the hard chine gives greater buoyancy than a curved configuration. In addition, the hard chine riding at the water line level directs the water flow outwardly from the hull reducing the wetted surface area at speed. The higher free board and the hard chine, as well as the planing, keep the crew much drier at high speeds than the ordinary displacement hull.

The bottom surface is a unique planing configuration. A flat inclined surface extends across the entire width of the hull from the keel line at the lowest point to the chine line at water level. This flat surface produces the planing capability which permits the hull to quickly ride up and over the bow wave to achieve planing. The inability of a typical planing hull to provide lateral force to resist side slip is an important design feature of this planing surface. The planing surface is tilted upwardly at a substantial dead rise angle. Its entire width from the lowermost point at the keel line to its termination at water level at the chine line provides an inclined surface which will generate a substantial additive lateral force to resist the side slip otherwise resulting from the side force applied to the hull by the sails. This is an important aspect of this hull design, since in most cases, the lateral force exerted against this planing hull bottom when added to the corresponding lifting lateral force generating along the inner surface, resists side slip sufficiently to eliminate the need for center boards or fin elements to counter the side forces.

The relocation of the keel line from the center, (which is typical for all hull types) to the inner surface is also a unique and important design feature. This gives greater depth to the inner surface, and also provides a planing bottom having an entire surface generating lateral forces in the desired direction especially true in the heeled condition. The conventional center line location at the lowest point on the hull, gives two oppositely inclined surfaces which counteract each other and do not produce a lateral force of any magnitude.

Consequently, this design overcomes the inherent limitations of displacement type catamarans which are limited to a finite speed to length ratio due to the hull's inability to produce a dynamic component of vertical lift to permit the hull to ride up over water.

This new hull design overcomes the limitations of displacement hulls in this respect, by using the modified and unconventional planing configuration along its bottom. The bow section has high dead rise angle and is blended into the planing surface with a slight progressive twist where for example a dead rise angle approaching 90 degrees at the bow is progressively decreased to a dead rise angle of approximately 20 degrees about one third the hull length from the bow. With this configuration, the new hull performs well at lower displacement type speeds as well as the higher planing speeds. Additionally, the hull performs well in waves.

The low drag air foil shape, and the new hard chine planing bottom each contribute performance characteristics that substantially increase the attainable maximum speed of a catamaran.

To maximize the hull performance characteristics, it is also necessary to give a slight bottom surface rise from the planing surface to the bow, as well as from the central planing area to the stern. This rocker configuration, when combined with the effect of a constantly changing beam width, bring the keel line into a continuous three dimensional curve, as it is calculated from the defined chine line reference. The constant dead rise angle for the planing bottom, which is an important aspect for maximum planing performance, is difficult to construct, because of the combined effect of rocker and changing beam width.

Successive measurements along the hull of length using the formula of FIGS. 15 and 16 to find the preferred keel line location on the inner surface, has been found to be the only practical approach to obtaining the hull configuration with constant dead rise angle. The deck is a starting point for obtaining the hull configuration by providing the curved flat sides on which the chine lines (with rocker curve) can be marked. The location of the keel line can then be obtained from the formula for FIGS. 15 and 16, based upon the desired dead rise angle for a given point along the hull length.

While this invention has been described as having preferred design, it is understood that it is capable of further modification, uses and/or adaptations of the invention following in qeneral the principle of the invention and including such departures from the present disclosure as come within known or customary practice in the art to which the invention pertains, and as may be applied to the essential features set forth, and fall within the scope of the invention or the limits of the appended claims.

What is claimed is:

1. A hull for a multi-hull sail boat, comprising:

(a) a relatively long high length to width ratio tapering curved hull with low hydrodynamic drag which has its maximum width approximately 60 percent of the distance from the bow to the stern, (b) a flat downwardly extending inner side surface which curves outwardly from the bow to a maximum at the mid section of the hull and tapers inwardly slightly as it approaches the stern so that water passing over this surface creates a lifting force normal to the surface, (c) the lowermost edge of the inner surface being the keel line of the hull, (d) the outer surface of the hull being flat and extending vertically downward to terminate along a chine line, (e) the depth of the outer side surface from the deck to the chine section being the desired free board, (f) a bottom relatively flat planing surface extending downwardly from the chine section at a substantial and constant dead rise angle along the planing section of the hull, (g) the dead rise angle increasing smoothly and progressively from the forward limit of the planing surface to the bow of the hull, (h) the bottom having a slight upward bend at bow and stern to provide rocker, and (i) the keel line having a three dimensional convex curvature in both the horizontal and vertical plane as a result of the intersection of the downward extending inner surface, and the dead rise planing surface extending from the chine.

2. The hull for a multi-hull sail boat as set forth in claim 1, wherein:

(a) the bottom surface has a constant dead rise angle along its central planing section.

3. The hull for a multi-hull sail boat, as set forth in claim 1, wherein:

(a) the bottom surface has a dead rise angle selected to maximize planing performance.

4. The hull as set forth in claim 1, wherein:

(a) the bow section of the hull has a dead rise angle ranging from 90 degrees to 2 degrees to minimize wave decelerations.

5. The hull for a multi-hull sail boat, as set forth in claim 7, wherein:

(a) the angle of dead rise at the mid and rear sections is approximately 20 degrees.

6. The hull for a multi-hull sail boat, as set forth in claim 7, wherein:

(a) the mid and rear sections of the hull have dead rise angles of between 2 degrees and 50 degrees.

7. The hull for a multi-hull sail boat, as set forth in claim 1, wherein:

(a) the inner and outer sides are symmetrical with respect to the longitudinal center line of the hull and are configured in a low drag, high lift configuration, and (b) the inner and outer sides are slightly asymmetrical with respect to the center line, with the inner side being slightly more bulbous with respect to the center line with both sides configured in a low drag, high lift configuration.

8. The hull for a multi-hull sail boat, as set forth in claim I, wherein:

(a) a chine width section extends along a major portion of the hull length adjacent the chine.

9. The hull for a multi-hull sail boat, as set forth in claim 4, wherein:

(a) the bow section of the hull has a dead rise angle ranging from 90 degrees to 2 degrees to minimize wave decelerations, and (b) the mid and rear sections of the hull have a dead rise angle of between 2 degrees and 50 degrees to generate sufficient, dynamic planing force.

10. The hull for a multi-hull sail boat, as set forth in claim 1, wherein:

(a) the bottom planing surface contains a small amount of concavity to trap air and enhance early planing performance.

* * * * *